US005988418A

United States Patent [19]

Maeshima

[11] Patent Number: 5,988,418

[45] Date of Patent: Nov. 23, 1999

[54] SYNTHETIC RESIN HANDLE AND BOTTLE HAVING THE SAME

[75] Inventor: Masaki Maeshima, Ueda, Japan

[73] Assignee: A. K. Technical Laboratory Inc., Japan

[21] Appl. No.: 09/245,483

[22] Filed: Feb. 4, 1999

Related U.S. Application Data

[63] Continuation of application No. 08/864,278, May 28, 1997.

[30] Foreign Application Priority Data

May 29, 1996 [JP] Japan ..... 8-135042

[51] Int. Cl.[6] ..... B65D 23/12

[52] U.S. Cl. ..... 215/396; 220/759; 220/770; 294/27.1

[58] Field of Search ..... 215/395, 396; 294/27.1, 33; 220/752, 759, 770

[56] References Cited

U.S. PATENT DOCUMENTS

| | | |
|---|---|---|
| 4,257,525 | 3/1981 | Thompson . |
| 4,281,770 | 8/1981 | Rainville . |
| 4,368,826 | 1/1983 | Thompson . |
| 4,964,522 | 10/1990 | Umetsu et al. . |

FOREIGN PATENT DOCUMENTS

| | | |
|---|---|---|
| 482203 | 4/1992 | European Pat. Off. . |
| 2584913 | 1/1987 | France . |
| 3200889 | 1/1983 | Germany . |
| 5-94129 | 12/1993 | Japan . |
| 1836258 | 8/1993 | U.S.S.R. . |
| 96 37416 | 11/1996 | WIPO . |

*Primary Examiner*—Gary E. Elkins
*Assistant Examiner*—Tri M. Mai
*Attorney, Agent, or Firm*—Ostrolenk, Faber, Gerb & Soffen, LLP

[57] ABSTRACT

There is provided a handle comprising a grip portion 2 which is longitudinally long enough to extend from an upper edge to a lower edge of a recess 21 in a side portion of the bottle 20, an upper contact plate 4 which projects inward and obliquely downward from the bottom of a holding portion 3 provided on an upper end of the grip portion and has an engagement piece 6 projecting upward and facing the holding portion 3, and a lower contact plate 5 which is formed from a lower end of the grip portion, bent inward and obliquely upward and has an engagement piece 7 projecting downward at its distal end. A connection step portion 10 is formed in an upper end portion of the lower contact plate 5 and a fixing plate 9 having such a length that its distal end reaches the inside of the connection step portion 10 extends obliquely toward the grip portion by bending its connection portion with the upper contact plate 4. Since a fixing plate for contact plates which are formed from an upper end and a lower end of a grip portion and project toward the inner side of the grip portion is molded integrally with the grip portion, the handle can be firmly fixed in a recess in a side portion of a synthetic resin bottle.

8 Claims, 3 Drawing Sheets

SYNTHETIC RESIN HANDLE AND BOTTLE HAVING THE SAME

This is a continuation of application Ser. No. 08/864,278, filed May 28, 1997.

BACKGROUND OF THE INVENTION

1. Field of the Invention

This invention relates to a synthetic resin handle for use with a synthetic resin bottle produced by stretchblow molding and to a bottle having the handle which is attached to one surface of a thin side portion thereof.

2. Background Art

It is technically difficult to mold a handle integrally with a side portion of a synthetic resin bottle made from a thermoplastic resin such as polyethylene terephthalate, polypropylene or polycarbonate and formed by stretching and blowing a preform formed by injection molding in a blow mold to make the side portion thereof thin, unlike a thick resin bottle formed by blow molding. Therefore, a separately molded handle is attached to the side portion of the synthetic resin bottle, making use of insert molding or employing an engagement means after the bottle is molded.

As the synthetic resin bottle having a handle attached thereto, there is known one in which a doweled projection is provided at a handle attachment position of a bottle main body, the handle main body is attached to the bottle main body by fitting the attachment engagement projection of the handle main body in an engagement recess portion at a base portion of the projection, and then the handle main body is fixed to the bottle main boy using a lock fixing plate or lock fixing member.

The handle is attached to the bottle by the engagement between the doweled projection and the recess portion, making use of the deflection of a foot portion of the handle. Therefore, the doweled projection cannot be fitted into the engagement recess portion deeper than the deflection of the foot portion and hence, the engagement is not satisfactory. Therefore, when a bottle having heavy contents is lifted up by holding the handle, the handle is often disconnected from the bottle because it cannot resist the weight of the bottle. When the deflection of the foot portion is increased for the engagement, the foot portion is deflected by the weight of the bottle and the doweled projection is disengaged from the recess portion. Therefore, there is limitation to the deflection of the foot portion.

Although the use of the above lock fixing plate or the like is an extremely effective means in preventing the deflection of the foot portion, since the deflection of the foot portion is prevented by using the fixing plate or the like formed separately from the handle, molds for the handle and the fixing plate are required for the production of the bottle and molding must be carried out twice, thereby boosting production costs.

To attach the handle to the bottle, it is necessary to set the fixing plate aslant on the grip portions of upper and lower foot portions so that it does not interfere the insertion of the foot portions. To prevent the fixing plate from falling off at the time of setting, a complex structure that both ends of the fixing plate are formed into engagement edges must be employed. Therefore, the production costs of the bottle is boosted as a container having the above problems.

The present invention is made to solve the above problems when the handle is attached to a barrel side portion of a bottle main body by engagement. It is an object of the present invention to provide a synthetic resin handle which can be firmly fitted in a recess in a side portion of a synthetic resin bottle by fixing simply and easily upper and lower contact plates without setting a fixing plate for contact plates which are formed from an upper end and a lower end of a grip portion and project toward the inner side of the grip portion because the fixing plate is molded integrally with the grip portion, as well a bottle having the same.

SUMMARY OF THE INVENTION

According to a first aspect of the present invention, there is provided a synthetic resin handle which comprises a grip portion which is longitudinally long enough to extend from an upper edge to a lower edge of a recess in a side portion of a bottle, an upper contact plate which projects inward and obliquely downward from the bottom of a holding portion provided on an upper end of the grip portion and has an engagement piece projecting upward and facing the holding portion, and a lower contact plate which is formed from a lower end of the grip portion, bent inward and obliquely upward and has an engagement piece projecting downward at its distal end, wherein a connection step portion is formed in an upper end portion of the lower contact plate and a fixing plate having such a length that its distal end reaches the inside of the connection step portion extends obliquely toward the grip portion by bending its connection portion with the upper contact plate.

According to another aspect of the present invention, there is provided a bottle having the above synthetic resin handle which is fixed in a synthetic resin bottle main body which is formed by stretch-blow molding and has a recess for attaching the handle on one surface of a thin side portion thereof and engagement recesses which are long horizontally and formed in upper and lower walls of the recess by integrating the upper and lower contact plates through the engagement between the engagement pieces of the upper and lower contact plates inserted into upper and lower surfaces of the recess in the side portion of the bottle and the engagement recesses in the upper and lower walls of the recess and the engagement between the fixing plate and the connection step portion in the top end portion of the lower contact plate.

As the starting material of the bottle main body may be used thermoplastic resins such as polyethylene terephthalate, polypropylene, polycarbonate, polyethylene, polyethylene naphthalate and the like, and as the starting material of the handle may be used thermoplastic resins having elasticity and toughness such as polypropylene, polyethylene, nylon and the like.

BRIEF DESCRIPTION OF THE DRAWINGS

These and other objects as well as advantages of the present invention will become clear by the following description of a preferred embodiment of the present invention with reference to the accompanying drawings, wherein.

DETAILED DESCRIPTION OF THE PREFERRED EMBODIMENTS

Figure 1:
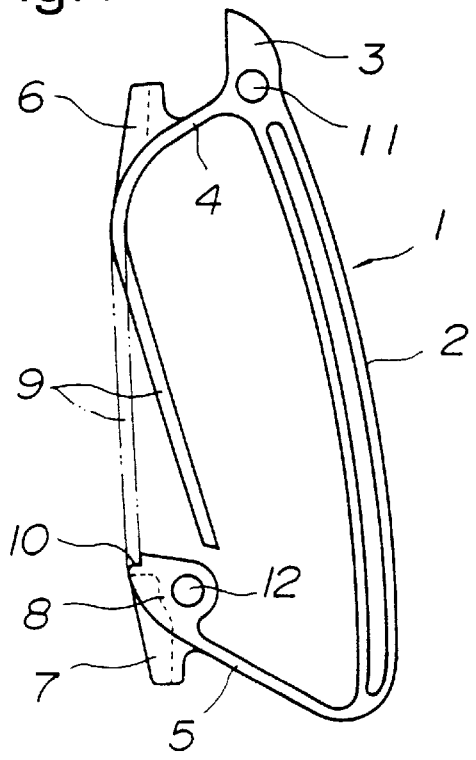
FIG. 1 is a side view of a synthetic resin handle according to an embodiment of the present invention.
Figure 2:
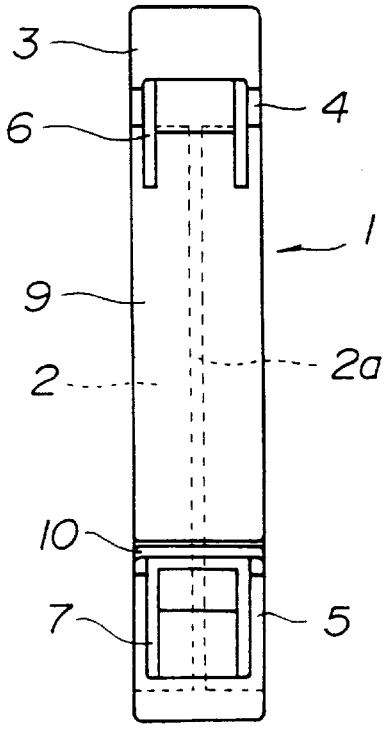
FIG. 2 is a front view of the synthetic resin handle.
Figure 3:
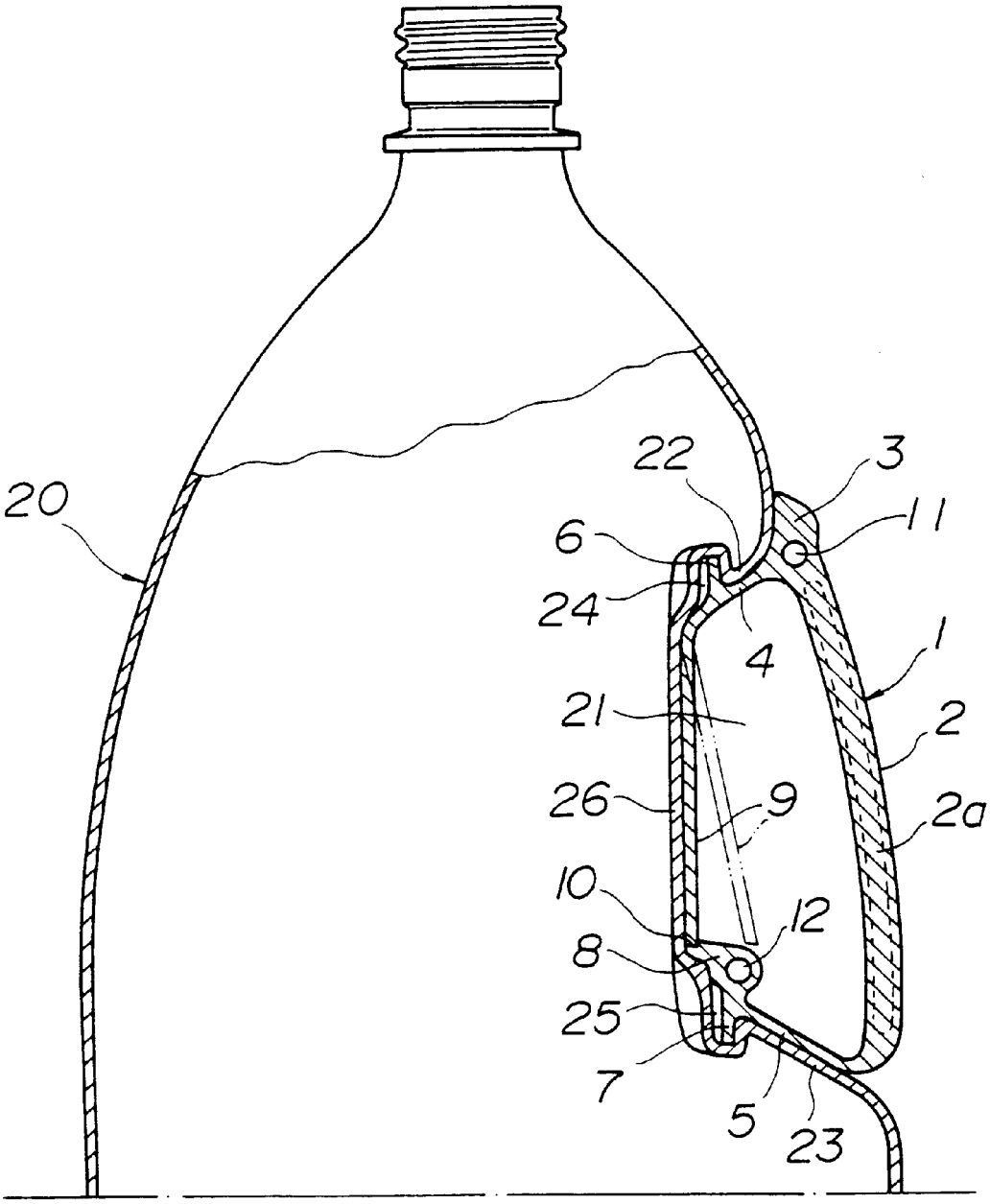
FIG. 3 is a longitudinal side view of key parts of a bottle having the synthetic resin handle of the present invention.

In the figures, reference numeral 1 is a handle molded of polypropylene by injection molding and consisting of a rectangular grip portion 2 which is long longitudinally, an upper contact plate 4 which projects inward from the bottom of a holding portion 3 provided on an upper end of the grip portion 2, and a lower contact plate 5 which projects from a lower end of the grip portion 2 and curves inward.

The grip portion 2 has a H-shaped cross section and a web 2*a* at a central portion thereof and gently curves inward. The upper contact plate 4 and the lower contact plate 5 are formed integrally with the grip portion 2 in such a manner that the upper contact plate 4 is inclined downward and the lower contact plate 5 is inclined upward on the inner side of the grip portion 2. The upper contact plate 4 and the lower contact plate 5 have the same width as the grip portion but their thicknesses are such that they produce a certain degree of deflection.

An engagement piece 6 is provided on the top surface of the upper contact plate 4 and faces holding portion 3 in such a manner that it projects upward and an engagement piece 7 is provided on the under surface of a top end portion of the lower contact plate 5 in such a manner that it projects downward. An upper top end portion 8 of the engagement piece 5 is formed inward like a thick block and a connection step portion 10 to be engaged with the end of a fixing plate 9 and extending from the upper contact plate 4 is formed in the end of the top end portion 8 in a transverse direction.

The fixing plate 9 has a connection portion which greatly curves inward from the bottom of the engagement piece 6 of the contact plate 4, extends long and obliquely toward the grip portion to a length such that its distal end reaches the inside of the connection step portion 10, and has the function of returning to its original position against pressure force by flexibility produced by the curvature of its connection portion. The engagement pieces 6 and 7 are formed of projection pieces having an U-shaped plane cross section and an opening in an outward direction to prevent a sink mark produced at the time of molding a thick portion. Reference numerals 11 and 12 are holes for preventing a sink mark in the holding portion 3 and the top end portion 8, respectively, and can be used as a hole for inserting a jig for attaching the handle.

The handle 1 structured above is attached to a synthetic resin bottle 20 having a thin barrel portion formed by stretch-blow molding by fitting it into a recess 21 for attaching the handle formed on one surface of a side portion of the bottle 20. An upper wall 22 of the recess 21 is inclined downward and an lower wall 23 is inclined upward, and engagement recesses 24 and 25 which are long horizontally are formed in the surfaces of the respective walls.

Figure 4:
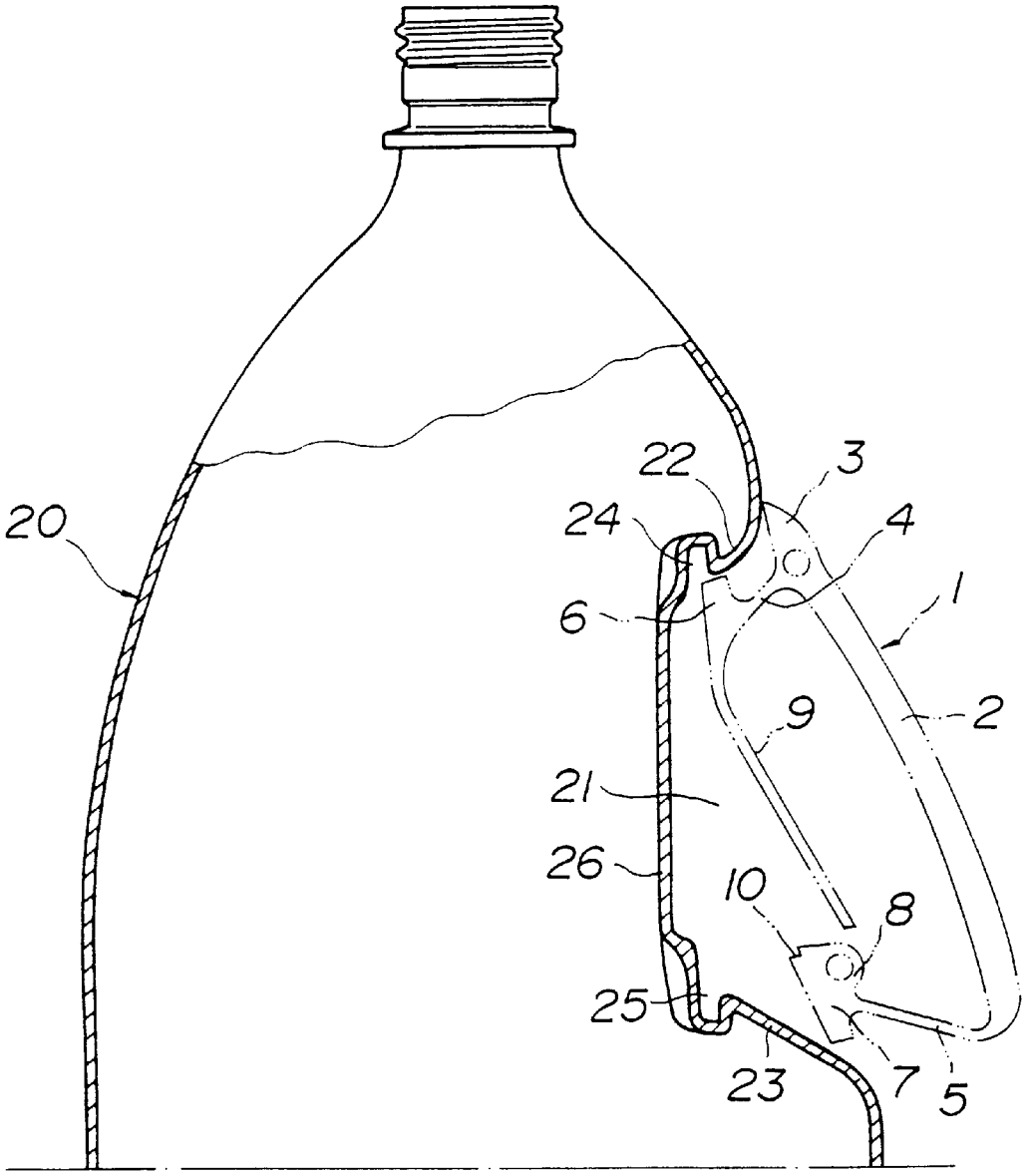
FIG. 4 is a longitudinal side view of key parts of a bottle showing the synthetic resin handle attached thereto.

The handle 1 can be attached to the recess 21 preliminarily as shown by chain lines in FIG. 4. That is, the upper contact plate 4 is first inserted diagonally into the recess 21 in the side portion of the bottle with the grip portion 2 positioned upright, the top end portion 8 of the lower contact plate 5 is forcedly pressed into the recess 21 until it contacts a vertical wall 26 while the engagement piece 6 is pressed into the engagement recess 24 in the upper wall 22, and then the engagement piece 7 is fitted into the engagement recess 25 in the lower wall 23.

Since the engagement pieces 6 and 7 are merely engaged with the engagement recesses 24 and 25 by reaction force against deflection produced by forcedly pressing the upper and lower contact plates 4 and 5 at the time of insertion, respectively, and not fixed firmly in this preliminary attachment, when outward tensile force is applied to the grip portion 2, the upper and lower contact plates 4 and 5 are bent, the engagement pieces 6 and 7 slip out of the engagement recesses 24 and 25, respectively, and the handle 1 is disconnected.

To cope with this problem, when a lower portion of the fixing plate 9 is pressed toward the innermost part of the recess 21 in the side portion of the bottle after the preliminary attachment, the fixing plate 9 bends slightly while it slides over the top surface of the top end portion 8 of the upper contact plate 5 whose distal end faces slightly upward, curves from the connection portion with the upper contact plate 4, and moves until it contacts the vertical wall 26. Since the engagement step portion 10 is opened at the bottom of the vertical wall 26, the distal end of the fixing plate 9 falls in the engagement step portion 10 by its deflection and engages with the engagement step portion 10. When the pressure force is removed, repulsive force that returns the fixing plate 9 to the original position is produced in the fixing plate 9 by the curved connection portion, whereby there is no play in the engagement between the fixing plate 9 and the connection step portion 10 and the fixing plate 9 is not disconnected unless it is bent to disengage the fixing plate 9 from the connection step portion 10.

By the engagement between the distal end of the fixing plate 9 and the connection step portion 10, the fixing plate 9 functions as a strut member between the upper contact plate 4 and the lower contact plate 5, and the upper and lower contact plates 4 and 5 are pressed against the upper and lower walls 22 and 23, respectively, to make tight the engagements between the engagement pieces 6 and 7 and the engagement recesses 24 and 25. Therefore, even if great tensile force is applied to the grip portion, the upper and lower contact plates 4 and 5 withstand the tensile force and prevents the handle 1 from being disconnected from the bottle.

To disconnect the handle 1, a thin-plate jig is inserted between the fixing plate 9 and the vertical wall 26, and the fixing plate 9 is forcedly bent to remove the distal end of the fixing plate 9 from the connection step portion 10.

In the handle 1 in which the fixing plate 9 to be engaged with the connection step portion 10 of the top end portion 8 of the lower contact plate 5 extends from the upper contact plate 4, it is not necessary to set the fixing plate 9 in such a manner that it does not fall in the space between the upper and lower contact plates 4 and 5 at the time of attaching the fixing plate 9, unlike the case where the fixing plate is formed separately from the handle, and the handle 1 is simply pressed in directly to engage the distal end of the fixing plate with the connection step portion. Therefore, the attachment work of the handle 1 is extremely simple and can be made automatically without aid of human labor.

Since the fixing plate 9 is integrally molded with the handle 1, a mold for the fixing plate is not necessary and the fixing plate itself extends from the upper contact plate 4. Therefore, the structure of the handle is not complex and only the handle is molded, thereby reducing molding costs. As a result, the handle can be produced at a low cost.

What is claimed is:

1. A synthetic resin handle which comprises a grip portion which is longitudinally long enough to extend from an upper edge to a lower edge of a recess in a side portion of a bottle, said bottle recess including an inner surface between the upper and lower edges, said grip having an upper end and a lower end said grip upper end having a holding portion which has an upper surface and a bottom, an upper contact plate which projects inward and downward from the holding portion, a first engagement piece projecting upward from the upper surface of the upper contact plate and facing the holding portion, a lower contact plate having an upper surface and extending from the lower end of the grip portion to a distal end formed as a thick block, the lower contact plate being bent inward and upward, a second engagement piece projecting downward from the lower contact plate, a connection step portion at the distal end of the upper surface of the lower contact plate distal end, said connection step facing said inner surface of said recess when said handle is engaged with said bottle and an inwardly curved fixing plate extending from the upper contact plate and having such a length that its distal end reaches the inside of the connection step portion, wherein the upper contact plate and lower contact plate are deflectable to permit the plates to be urged toward one another when the fixing plate is out of contact with connection step and wherein the fixing plate has sufficient flexibility to permit its distal end to be deflected out of contact with the connection step and toward the grip portion and sufficient rigidity to function as a strut when the distal end is in contact with the connection step portion and the upper and lower contact plates are urged away one another.

2. A synthetic resin handle according to claim 1, wherein the upper contact plate projects inward and downward from the bottom of the holding portion.

3. A synthetic resin handle according to claim 2, wherein the second engagement piece projects downward from the lower contact plate distal end.

4. A synthetic resin handle according to claim 3, wherein the grip portion has an H-shaped cross-section.

5. A bottle having a handle comprising:

a stretch-blow molded synthetic resin main body and having a recess for attaching a handle on one surface of a thin side portion, the recess having upper and lower walls and an inner surface extending between the upper and lower walls, engagement recesses which are long horizontally and formed in the upper and lower walls of the recess; and a synthetic resin handle which comprises a grip portion which is longitudinally long enough to extend from an upper edge to a lower edge of the recess in the thin side portion surface, said grip having an upper end and a lower end said grip upper end having a holding portion which has an upper surface and a bottom, an upper contact plate which projects inward and downward from the holding portion, a first engagement piece projecting upward from the upper surface of the upper contact plate to an end and facing the holding portion, a lower contact plate having an upper surface and extending from the lower end of the grip portion to a distal end formed as a thick block, the lower contact plate being bent inward and upward, a second engagement piece projecting downward from the lower contact plate to an end, a connection step portion at the distal end of the upper surface of the lower contact plate distal end, said connection step facing the inner surface of said recess when said handle is engaged with said bottle and an inwardly curved fixing plate extending from the upper contact plate and having such a length that its distal end reaches the inside of the connection step portions wherein the upper contact plate and lower contact plate are deflectable to permit the plates to be urged toward one another when said fixing plate is out of contact with the connection step and wherein fixing plate has sufficient flexibility to permit its distal end to be deflected out of contact with the connection step and away the grip portion and sufficient rigidity to function as a strut when the distal end is in contact with the connection step portion and the upper and lower contact plates are urged toward one another;

and wherein the distance between the ends of the first and second engagement pieces is greater than the distance between recess upper and lower walls.

6. A bottle according to claim 5, wherein the upper contact plate projects inward and downward from the bottom of the holding portion.

7. A bottle according to claim 6, wherein the second engagement piece projects downward from the lower contact plate distal end.

8. A bottle according to claim 7, wherein the grip portion has an H-shaped cross-section.

* * * * *